US009821187B2

(12) United States Patent
Parr

(10) Patent No.: US 9,821,187 B2
(45) Date of Patent: Nov. 21, 2017

(54) EXERCISE EQUIPMENT AND METHOD OF EXERCISING UTILIZING A PULSE GENERATION

(71) Applicant: Robert Parr, Old Castle (CA)

(72) Inventor: Robert Parr, Old Castle (CA)

( * ) Notice: Subject to any disclaimer, the term of this patent is extended or adjusted under 35 U.S.C. 154(b) by 0 days.

(21) Appl. No.: 15/064,011

(22) Filed: Mar. 8, 2016

(65) Prior Publication Data

US 2017/0216653 A1 Aug. 3, 2017

Related U.S. Application Data

(60) Provisional application No. 62/289,991, filed on Feb. 2, 2016.

(51) Int. Cl.

| | |
|---|---|
| ***A63B 21/072*** | (2006.01) |
| ***A63B 21/075*** | (2006.01) |
| ***A63B 23/02*** | (2006.01) |
| ***A63B 21/00*** | (2006.01) |
| ***A63B 23/035*** | (2006.01) |

(52) U.S. Cl.

CPC ..... *A63B 21/0722* (2015.10); *A63B 21/0728* (2013.01); *A63B 21/4035* (2015.10); *A63B 23/0205* (2013.01); *A63B 23/0233* (2013.01); *A63B 23/03516* (2013.01)

(58) Field of Classification Search

CPC ..... A63B 21/0722; A63B 21/0728; A63B 21/4035; A63B 21/00196; A63B 23/03516; A63B 23/0233; A63B 23/0205

USPC ..... 273/440, 449; 473/212, 213, 422, 437, 473/438, 450, 458, 464; 446/236, 238, 446/246, 266

See application file for complete search history.

(56) References Cited

U.S. PATENT DOCUMENTS

| | | | | |
|---|---|---|---|---|
| 1,013,782 A * | 1/1912 | Koch | A63B 21/0004 | 482/108 |
| 3,874,660 A * | 4/1975 | Brethen | A63B 15/00 | 482/109 |
| 4,693,469 A * | 9/1987 | Cedar | A63B 21/0608 | 482/110 |
| 5,209,481 A * | 5/1993 | DeBack | A63B 21/0004 | 473/220 |
| 7,329,212 B2 * | 2/2008 | Roque | A63B 15/00 | 482/110 |
| 2007/0135275 A1 * | 6/2007 | Oates | A63B 21/0004 | 482/109 |
| 2015/0258368 A1 * | 9/2015 | Turnbow | A63B 21/0004 | 482/117 |

* cited by examiner

*Primary Examiner* — Loan H Thanh
*Assistant Examiner* — Megan Anderson
(74) *Attorney, Agent, or Firm* — Dinsmore & Shohl LLP

(57) ABSTRACT

An exercise equipment configured to exercise muscles by require the muscles to generate torque intermittently is provided. The exercise equipment includes a sleeve. A pipe is slidably disposed within the sleeve. The sleeve is concentric to the pipe wherein the outer surface of the pipe is spaced apart the inner surface of the sleeve. A counterweight is mounted to at least one end of the pipe wherein the rotation of the pipe along an orbital path causes the pipe to turn within the bore of the sleeve. The turning of the pipe is a result of the counterweights completing a revolution as the counterweights rotate about the longitudinal axis of the pipe. The turning of the pipe generates a pulse so as to actuate muscular structure within the body of the user.

2 Claims, 9 Drawing Sheets

EXERCISE EQUIPMENT AND METHOD OF EXERCISING UTILIZING A PULSE GENERATION

CROSS-REFERENCE TO RELATED APPLICATIONS

This application claims priority of U.S. Provisional Application 62/289,991 filed Feb. 2, 2016, the contents of which are incorporated herein by reference.

TECHNICAL FIELD

An exercise equipment and method of exercising configured to improve muscular structure and fitness by exhibiting a rotational pulse is provided.

BACKGROUND OF THE INVENTION

Exercise equipment which requires the user to actuate fast twitch muscles by generation of a pulse are currently known and used. For instance, some exercise devices commonly referenced as the Shake Weight® require the user to grip the device. The device generates pulses exhibiting micro loads on the user's muscles to further actuate the fast twitch muscles and increase the strength of the muscles. However, such devices require an energy source to actuate a vibratory pulsing mechanism.

Other devices which exhibit a pulse motion include a pivotal turntable and a handlebar. The turntable is mounted about a point and the handlebar is rotatable in a fixed path. Such devices require complicated assembly and take up a lot of space.

Accordingly, it is desirable to have an exercise equipment device which is relatively simple in construction, occupies less space relative to some current exercise equipment, and does not require a battery source to supply energy to achieve a pulse-related workout.

SUMMARY OF THE INVENTION

An exercise equipment configured to exercise muscles by requiring the muscles to generate torque intermittently is provided. The pulse actuates fast twitch muscles of the body so as to strength the muscles without imparting a lot of load relative to exercises such as weight lifting.

The device includes a sleeve. The sleeve is configured to be gripped by a user and defines an axial bore. A pipe is disposed within the bore. The sleeve is concentric to the pipe so as to allow the pipe to wiggle within the bore. The pipe includes an elongated body portion.

The exercise equipment further includes a counterweight. The counterweight may be attached to an end of the elongated body by a connecting member or may be fixedly mounted thereto. Rotation of the counterweight generates a pulse onto the user, actuating fast twitch muscles within the arms, back, neck, stomach and chest. The counterweights may be detachably removed from the ends of the elongated body so as to modify the intensity of the workout.

In operation the user grips the sleeve with one or both hands. The user holds the sleeve and rotates his/her hands in a generally orbital path. The orbital path may be on various planes. For instance, the user may begin by rotating the sleeve along an orbital path disposed on a generally vertical plane and then move the plane by rotation of the arm to a generally horizontal plane. In moving the sleeve along the orbital path, the user creates torque on the exercise equipment. The muscles create the torque in pulses.

A method of exercising is also provided. The method includes providing a sleeve and a pipe. The sleeve is concentric to the pipe. The pipe is disposed within the sleeve. The method further includes a step of providing a counterweight and attaching the counterweight to an end of the pipe.

The method proceeds to the step of gripping the sleeve with one or both hands and rotating his/her hands in a generally orbital path. The orbital path may be on various planes. For instance, the user may begin by rotating the sleeve along an orbital path disposed on a generally vertical plane and then move the plane by rotation of the arm to a generally horizontal plane.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE PREFERRED EMBODIMENTS

An exercise equipment configured to exercise muscles by require the muscles to generate torque intermittently is provided. The actuation of the exercise equipment strengthens the muscles without imparting a lot of load relative to exercises such as weight lifting.

The exercise equipment includes a sleeve. A pipe is slidably disposed within the sleeve. The sleeve is concentric to the pipe wherein the outer surface of the pipe is spaced apart the inner surface of the sleeve.

A counterweight is mounted to at least one end of the pipe wherein the rotation of the pipe along an orbital path causes the pipe to turn within the bore of the sleeve. The turning of the pipe is a result of the counterweights completing a revolution as the counterweights rotate about the longitudinal axis of the pipe. The turning of the pipe generates a pulse so as to actuate muscular structure within the body of the user. The counterweight may be detachably mounted to the pipe, and a plurality of counterweights of different shape and weight may be attached so as to decrease/increase the intensity of the workout.

Figure 1:
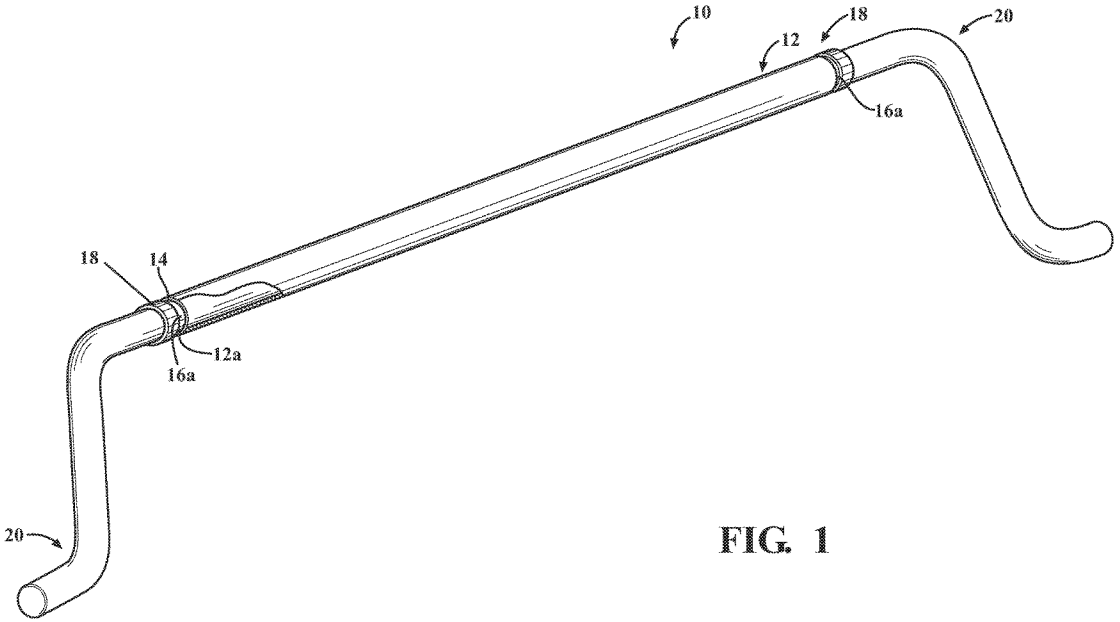
FIG. 1 is a perspective view of the exercise equipment.

With reference now to FIG. 1, an illustrative perspective view of the exercise equipment 10 is provided. The exercise equipment 10 includes a sleeve 12. The sleeve 12 includes a bore 14. The sleeve 12 may be configured to accommodate the grip of a user and has a length which may be varied based upon the size of the user and the desired intensity of the workout as described in further detail below. In the least the length of the sleeve 12 is configured to be gripped by one hand.

The exercise equipment 10 further includes a pipe 16. The pipe 16 has a diameter which is less than the diameter of the sleeve 12 wherein the outer surface 16*a* of the pipe 16 is spaced apart from the inner surface 12*a* of the sleeve 12 when mounted therein. The pipe 16 is dimensioned to be slidably disposed within the sleeve 12. The pipe 16 is shown disposed within the sleeve 12.

The exercise equipment 10 may include a connecting member 18 and a counterweight 20. The connecting member 18 is configured to couple the counterweight 20 to an end of the pipe 16. FIG. 1 shows a first embodiment of the exercise equipment 10 configured to be gripped by both hands wherein each end of the pipe 16 includes a counterweight 20.

The connecting member 18 may be dimensioned so as to have an area larger than the diameter of the sleeve 12 so as to maintain the pipe 16 within the confines of the bore 14 of the sleeve 12. For illustrative purposes the exercise equipment 10 is shown as having two connecting members 18 and a pair of counterweights 20 coupled on each end of the pipe 16.

The connecting members 18 are illustratively shown disposed on respective ends of the pipe 16. The connecting member 18 may be fixedly mounted to the distal ends of the pipe 16 and may be configured to engage attachment ends of a respective counterweight 20. In one illustrative example, the connecting member 18 is a threaded shaft configured to receive a threaded bore (attachment end) disposed one the end of a respective counter weight 20, see FIG. 3*c*).

Figure 2:
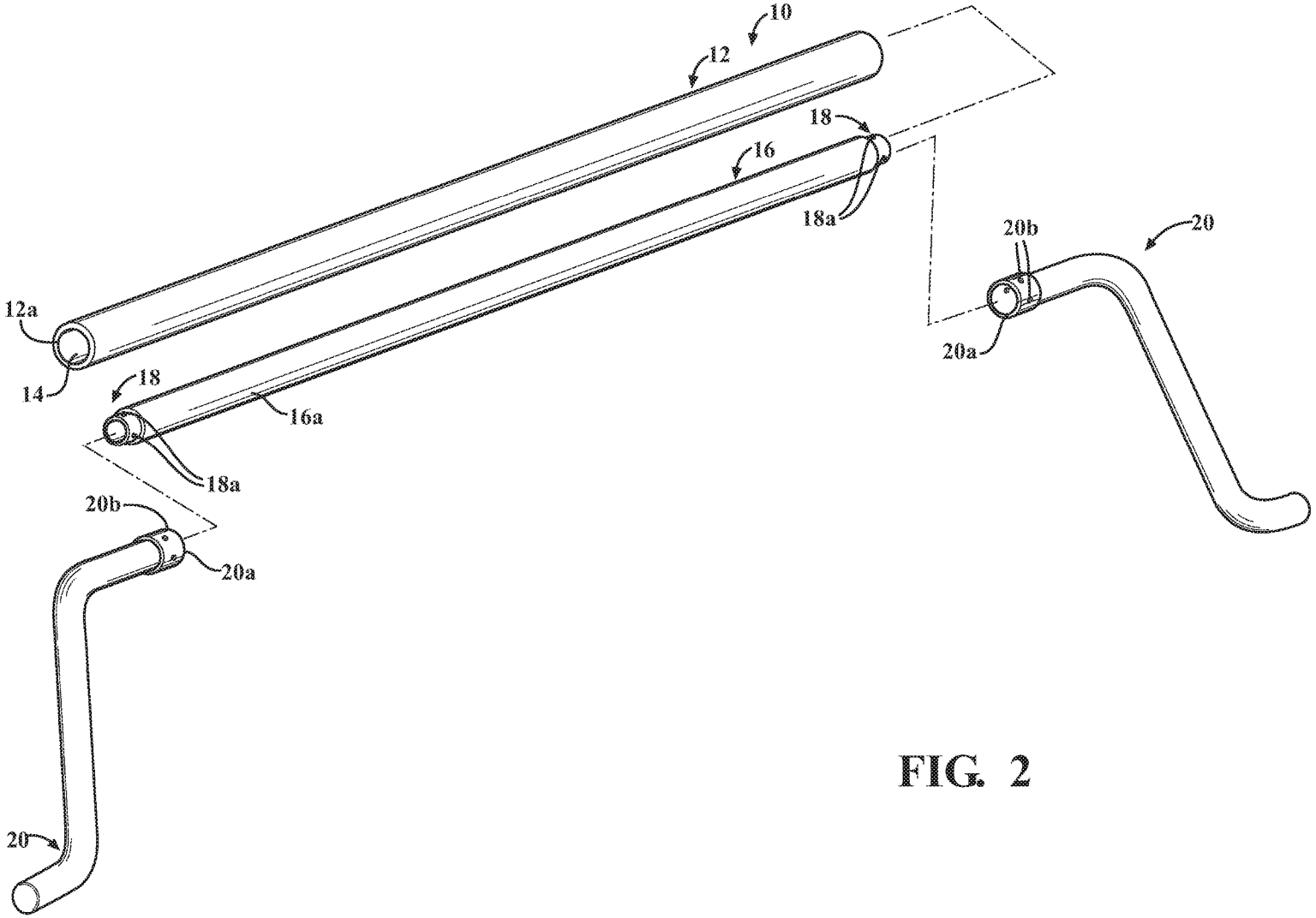
FIG. 2 is an exploded view of the exercise equipment shown in FIG. 1.

FIG. 2 provides an exploded view of the exercise equipment 10 shown in FIG. 1. FIG. 2 shows the length of the sleeve 12 as being generally 3 feet long. The pipe 16 has an elongated body portion and the connecting members 18 are fixedly disposed on respective ends of the pipe 16, the pipe 16 having an axial length longer than that of the sleeve 12. For instance, the pipe 16 may be forty (40) inches long. The counterweights 20 are shown spaced apart from respective connecting members 18. The counterweights 20 are illustratively shown as having a generally Z-shaped dimension.

The sleeve 12 and the pipe 16 may be formed of a durable and resilient material such as a polycarbonate or rubber. However, it should be appreciated that the sleeve 12 and the pipe 16 may be formed of a denser material such as steel. The pipe 16 may be solid or hollow depending upon the amount of weight and workout intensity desired. The counterweights 20 may be formed of steel or a polycarbonate as well, and may be solid or hollow.

In another embodiment of the connecting member 18 shown in FIG. 2, the connecting member 18 is configured fit within an end of the counterweight 20. The end of the counterweights 20 include a radial opening 20*a* configured to fittingly receive a respective connecting member 18. The connecting members 18 may further include a plurality of pins 18*a* which may be urged radially outward from a respective connecting member 18. For instance, a biasing member (not shown) may be disposed within the connecting member 18 so as to urge the pin outwardly. The end of the counterweights 20 may include a plurality of pin openings 20*b* each of which is configured to receive pins 18*a* wherein registration of a pin 18*a* with a respective pin opening 20*b* secures the counterweight 20 to the connecting member 18 and subsequently the pipe 16.

Figure 3A:
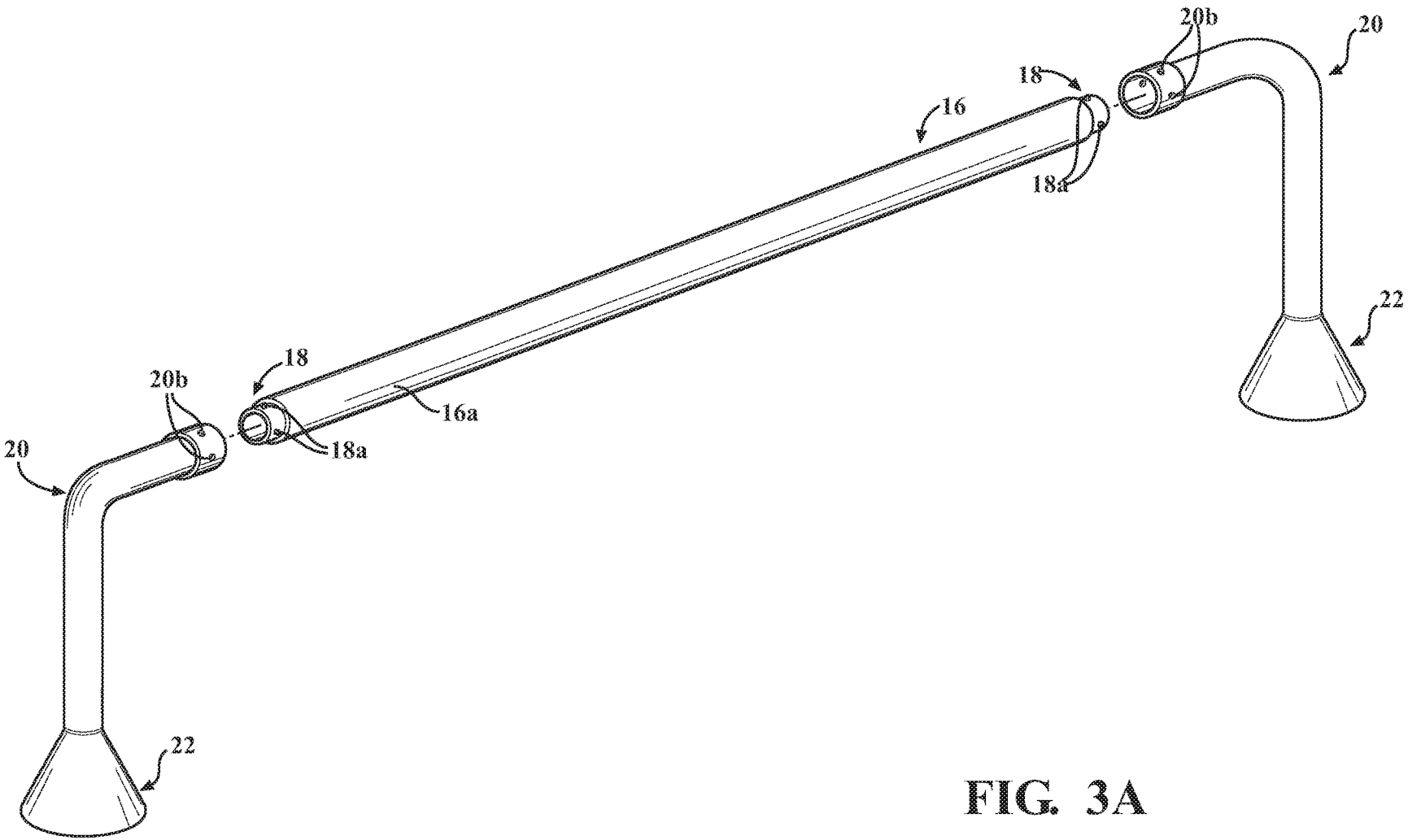
FIG. 3A is an illustrative embodiment of a counterweight.
Figure 3B:
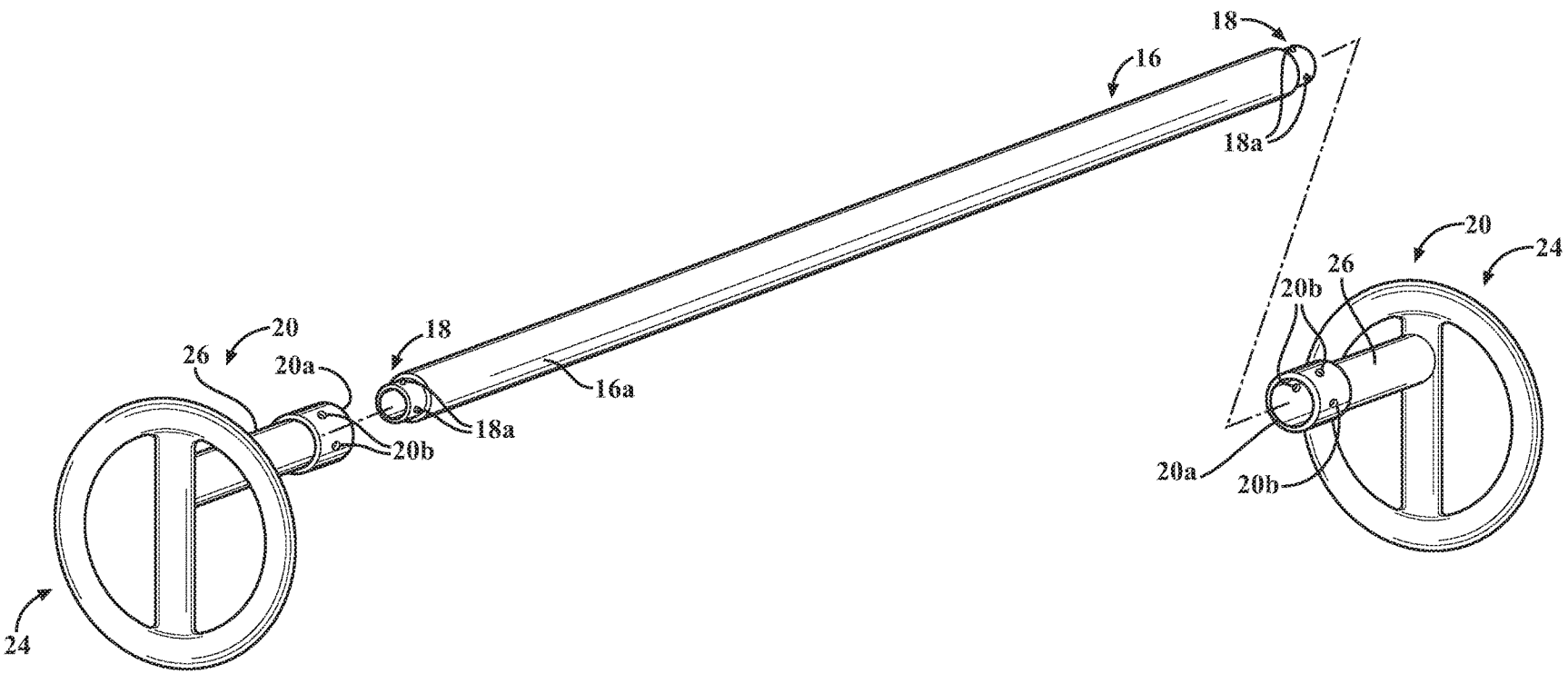
FIG. 3B is yet another illustrative example of a counterweight.
Figure 3C:
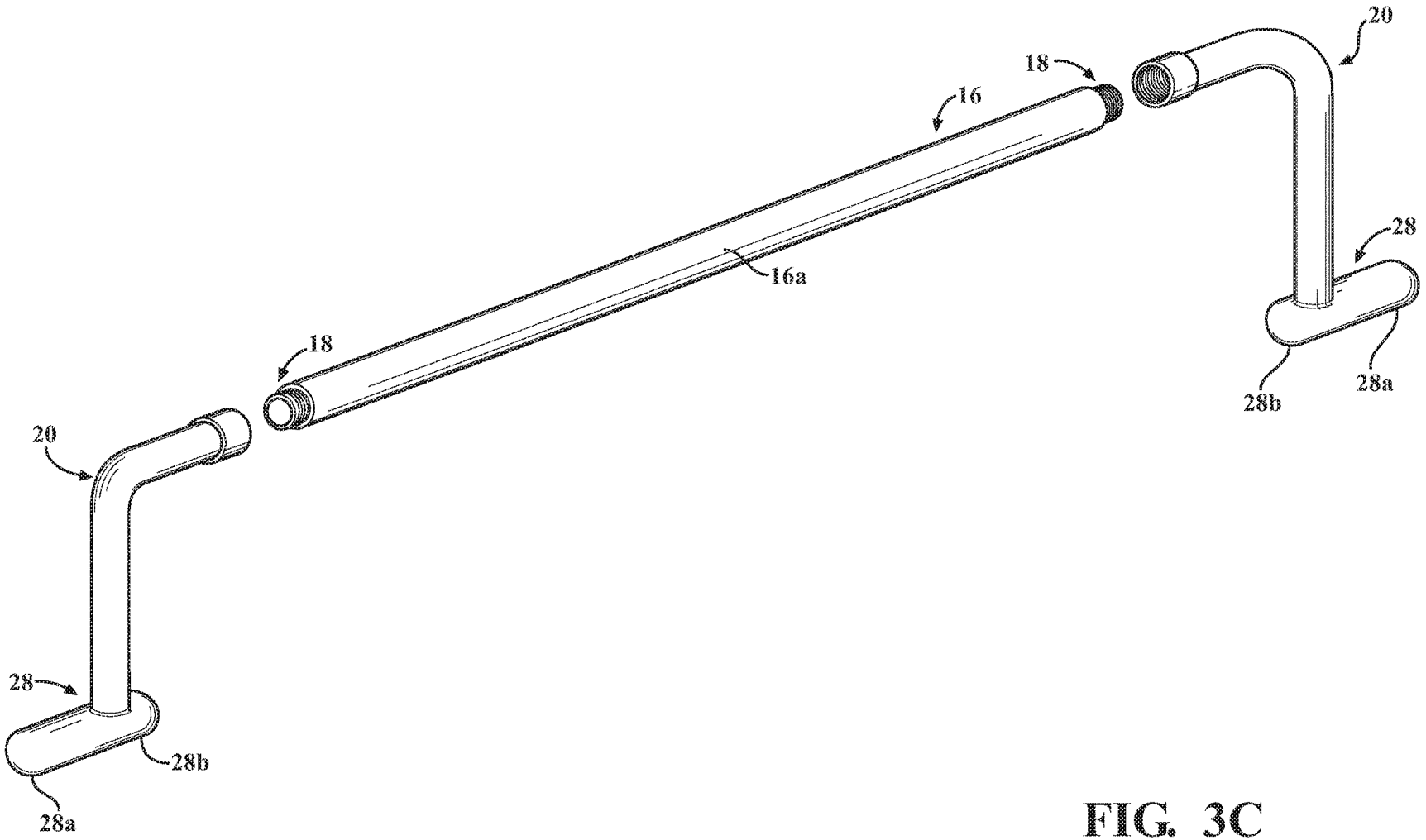
FIG. 3C is yet another illustrative example of a counterweight.

With reference now to FIGS. 3A-3C, illustrative examples of the shapes of the counterweights 20 are provided. FIG. 3A shows a counterweight 20 having a generally L-shaped dimension, having a bell shape 22 disposed on a distal end of the counterweight. FIG. 3B shows a counterweight 20 having a generally circular body 24 and a connecting arm 26 extending from a point offset from the center of the circular body. The connecting arm 26 includes a proximal end configured to detachably engage the connecting member 18. FIG. 3C shows a counterweight 20 having a generally T-shaped member 28 wherein a first portion 28*a* of the T is longer than a second portion 28*b* of the T.

It should be appreciated that the illustrations of the counterweights 20 provided above are meant to be illustrative and not limiting to the scope of the appended claims wherein the different shapes and the weight distribution and material provide different performances in terms of speed and flexibility of the pipe 16 and rotation of the counterweight 20 so as to achieve a predetermined or desired exercise result.

Figure 4A:
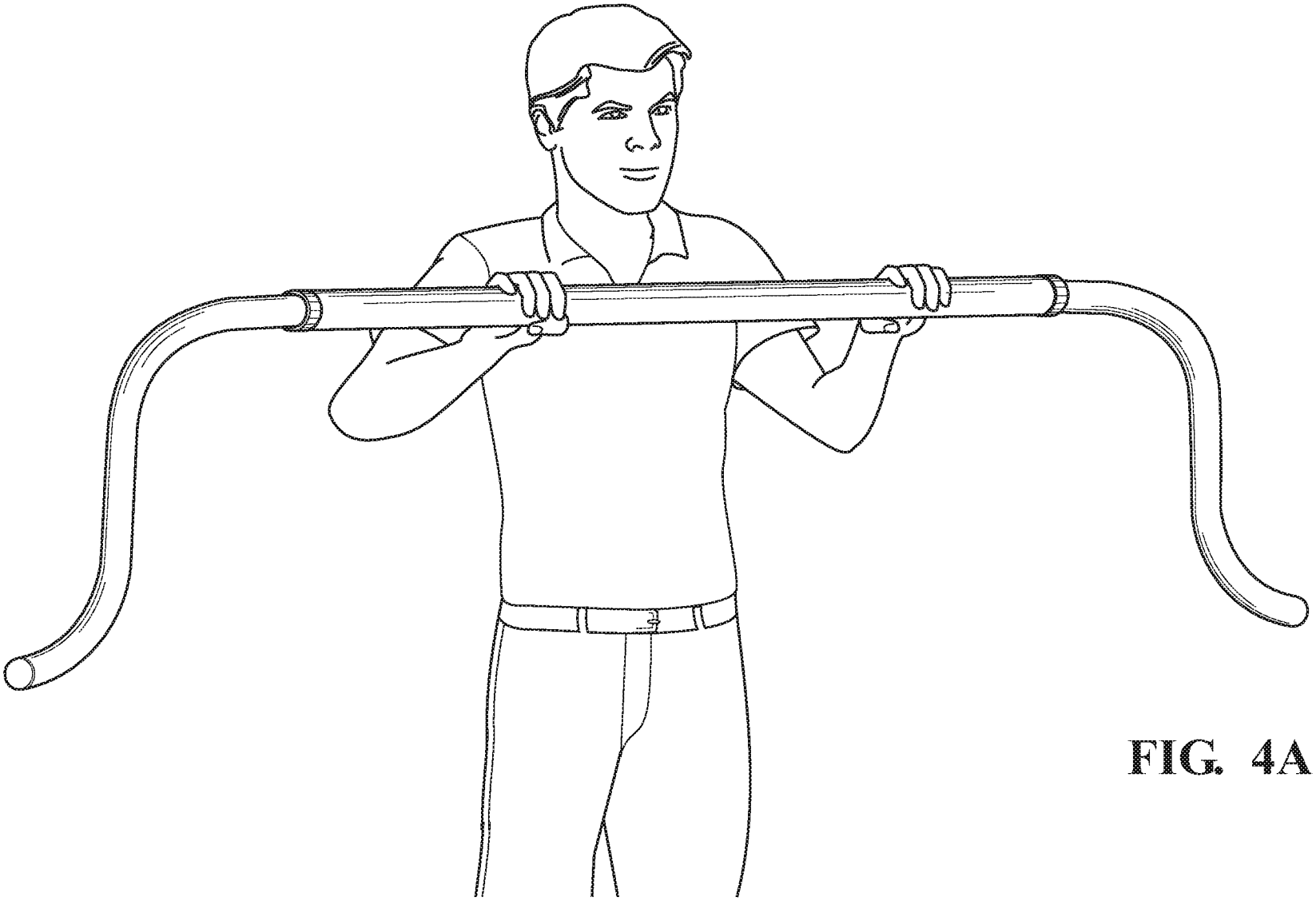
FIG. 4*a* is a perspective view of a user performing an exercise using the exercise equipment shown in FIG. 1.
Figure 4B:
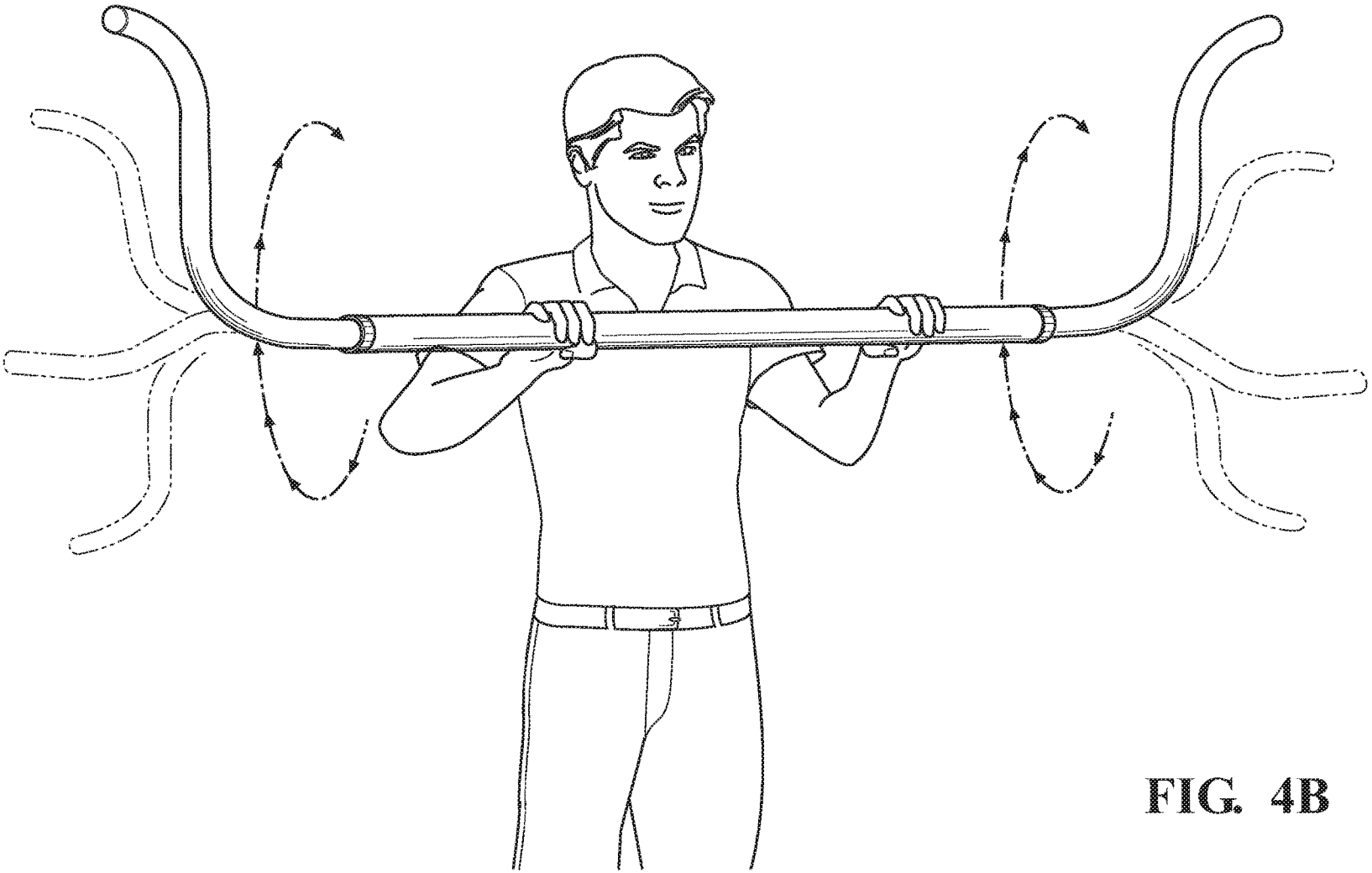
FIG. 4*b* is a view of FIG. 4*b* showing the counterweight advanced.

With reference now to FIGS. 4*a* and 4*b*, the operation of the exercise equipment 10 is provided. The user is shown gripping the sleeve 12 by two hands, however it should be appreciated that the user may use only one hand. The user holds onto the sleeve 12 wherein the arms may be placed shoulder width apart. The user is then shown rotating his hands and arms in a circular motion (indicated by the blue arrow) wherein the sleeve 12 is moved along an orbital path (indicated by the dashed circle) generally disposed on a vertical plane.

As the user rotates the sleeve 12 along an orbital path, the muscles are creating torque on the sleeve 12, pipe 16 and counterweights 20, which is necessary to maintain centripetal force sufficient to keep the counterweights 20 spinning about the pipe 16. Centripetal force makes the counterweights 20 follow a curved path. Centripetal force is directed orthogonal to the velocity of the counterweight 20 which subsequently requires the muscles to actuate to overcome the opposing force of the counterweight. The sleeve 12 may be rotated either clockwise or counterclockwise. The centripetal force causes the pipe 16 to turn within the sleeve 12 as a result of the counterweight 20 rotating about the longitudinal axis of the pipe 16.

FIG. 4*a* shows the counterweights 20 disposed at the bottom of the orbital path. As the counterweights 20 reach the bottom of the orbital path, a pulse is generated onto the body of the user, to include the arms, back, chest, stomach and neck. The pulse actuates the muscles, to include fast twitch muscles so as to stabilize the exercise equipment and constrain the exercise equipment along the orbital path.

FIG. 4*b* shows the counterweights 20 disposed at the top of the orbital path. The exercise equipment 10 may be further configured to generate a pulse as the counterweights 20 reach to top of the orbital path. An increased frequency of rotation spins the pipe 16 within the sleeve 12 wherein the counterweight 20 exhibits a pulse force upon each rotational path or orbital path which exhibits micro bits of load onto the arms and the body of the user. Further, it should be appreciated that other muscle areas of the user to include the neck and shoulders which imparts a pulse at the apex of rotation. Thus, the user is able to effectively exercise the neck and shoulders without bending the neck itself.

Figure 5:
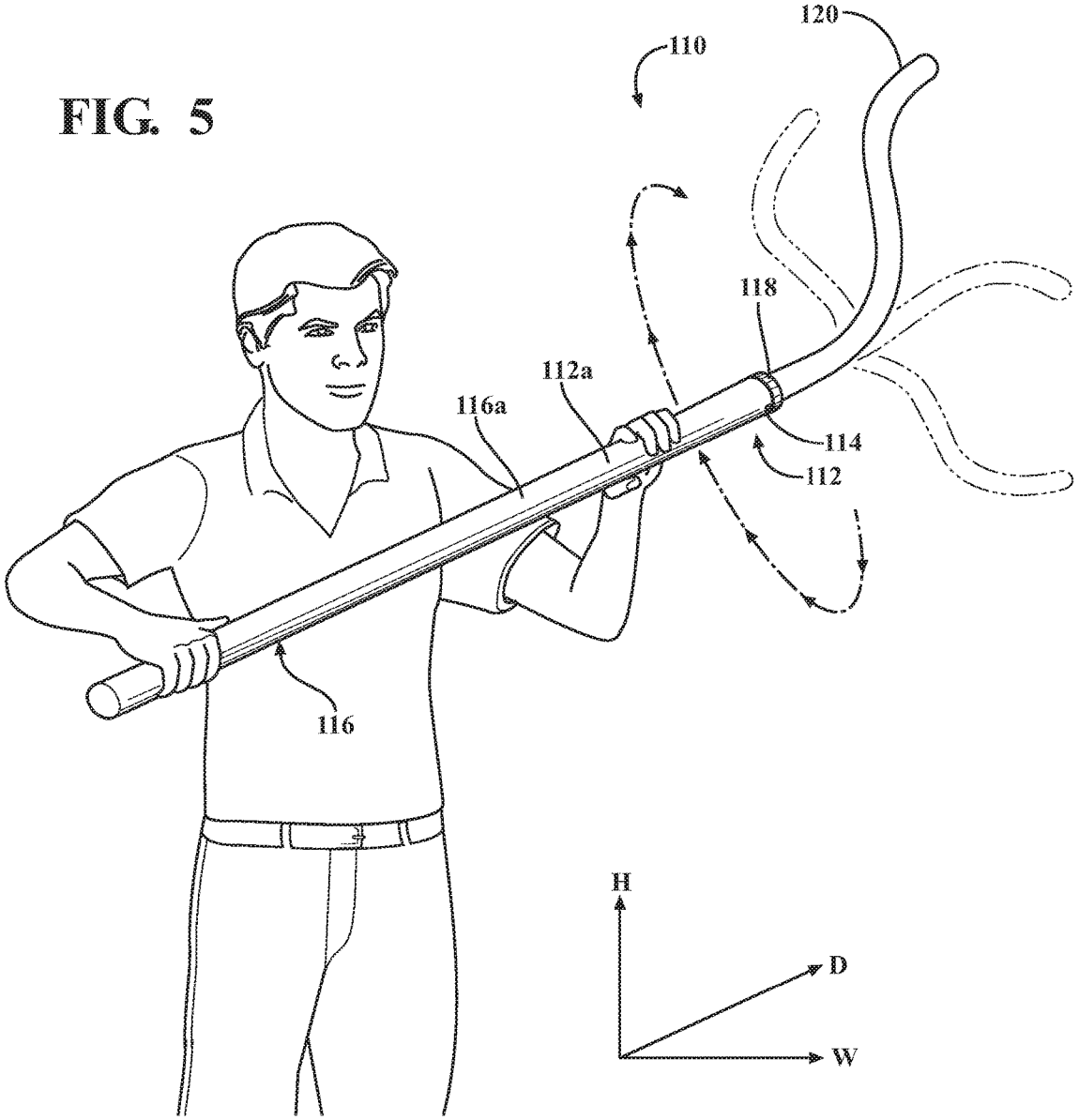
FIG. 5 is a perspective view of a second embodiment of the exercise equipment.

FIG. 5 is an illustrative perspective of a second embodiment of the exercise equipment 110, wherein like elements are referenced by like numbers increased by 100. The second embodiment of the exercise equipment 110 is also configured to generate a pulse by rotation of the exercise equipment 110 along an orbital path. However, unlike the first embodiment described above, the second embodiment of the exercise equipment 110 is configured to exercise one arm at a time.

The exercise equipment 110 includes a sleeve 112. The sleeve 112 includes a bore 114. The sleeve 112 may be configured to accommodate the grip of a user. In particular, the sleeve 112 has a length configured to accommodate a single grip.

The exercise equipment 110 further includes a pipe 116. The pipe 116 has a diameter which is less than the diameter of the sleeve 112 wherein the outer surface 116*a* of the pipe 116 is spaced apart from the inner surface 112*a* of the sleeve 112 when mounted therein. The pipe 116 is dimensioned to be slidably disposed within the sleeve 112.

The pipe 116 is shown disposed within the sleeve 112. A counterweight 20 may be detachably mounted one a distal end of the pipe 116 so as to extend beyond the outer edge of the sleeve 112. The counterweight 120 is configured to generate a pulse when rotated about the longitudinal axis of the pipe 116.

The exercise equipment 110 includes a connecting member 118. The connecting member 118 is configured to couple the counterweight 120 to an end of the pipe 116. The connecting member 118 is illustratively shown disposed the distal of the pipe 116. The connecting member 118 may be fixedly mounted to the distal end of the pipe 116 and may be configured to engage an attachment end of a respective counterweight 120. In one illustrative example, the connecting member 118 is a threaded shaft configured to receive a threaded bore (attachment end) disposed one the end of a respective counter weight 120.

Figure 6:
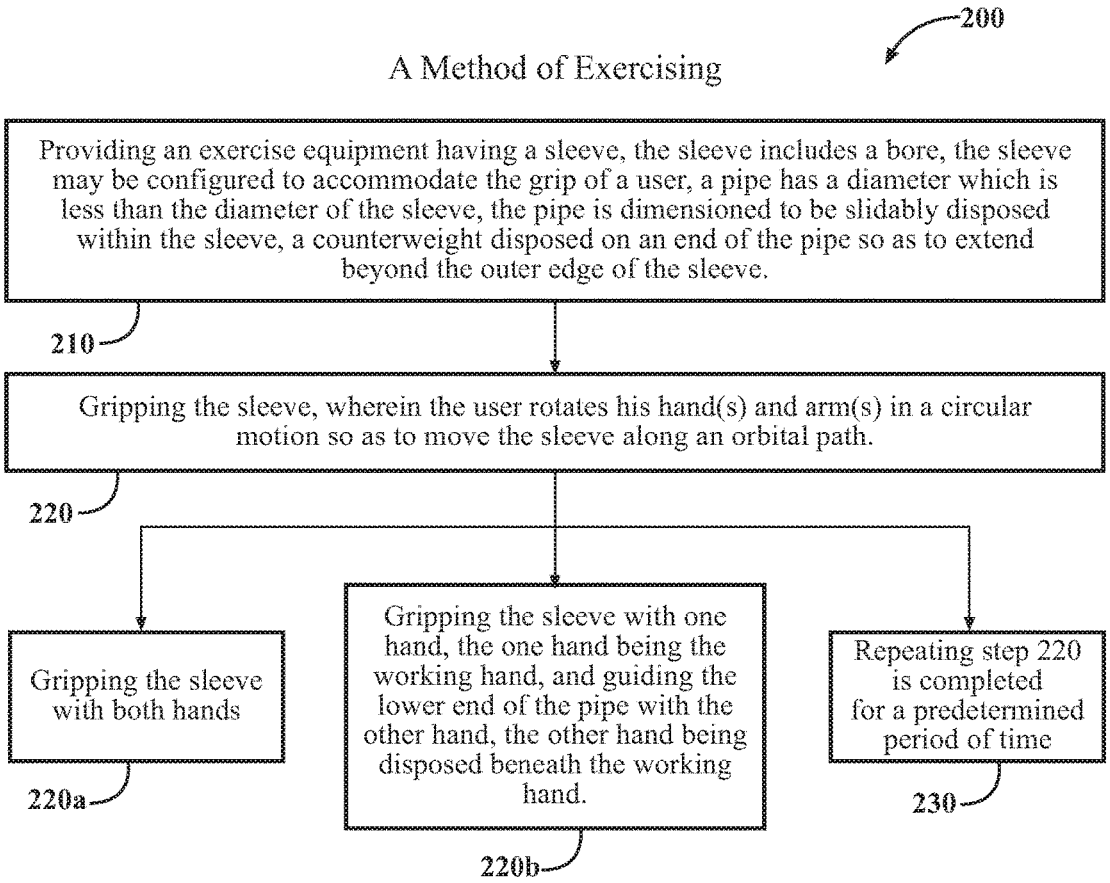
FIG. 6 is a diagram showing the steps of a method of exercising using the exercise equipment shown in FIG. 1.

With reference now to FIG. 6, a method 200 of exercising is provided. The method 200 includes step 210, providing an exercise equipment 10/110. The exercise equipment 10/110 includes a sleeve 12/112. The sleeve 12/112 includes a bore 14/114. The sleeve 12/112 may be configured to accommodate the grip of a user and has a length which may be varied based upon the size of the user and the intensity of a desired workout. In the least the length of the sleeve 12/112 is configured to be gripped by one hand.

The exercise equipment 10/110 further includes a pipe 16/116. The pipe 16/116 has a diameter which is less than the diameter of the sleeve 12/112 wherein the outer surface 16*a* of the pipe 16/116 is spaced apart from the inner surface 12*a* of the sleeve 12/112 when mounted therein. The pipe 16/116 is dimensioned to be slidably disposed within the sleeve 12/112. The pipe 16/116 is shown disposed within the sleeve 12/112 and the counterweight(s) 20/120 may be disposed on an end of the pipe 16/116. In one embodiment, a pair of counterweights 20 are disposed on opposite ends of pipe 16 so as to extend beyond the outer edges of the sleeve 12. In another embodiment, a single counterweight 120 is attached to an end of pipe 116.

The exercise equipment 10/110 may include least one connecting member 18. The connecting member 18 is configured to couple a counterweight 20 to an end of the pipe 16/116. Alternatively, the counterweight(s) 20/120 may be fixedly mounted to an end of the pipe 16/116. The connecting member 18/118 may be dimensioned so as to have an area larger than the diameter of the sleeve 12/112 so as to maintain the pipe 16/116 within the confines of the bore 14 of the sleeve 12/112.

The connecting members 18 are illustratively shown disposed on respective ends of the pipe 16. The connecting member 18 may be fixedly mounted to the distal ends of the pipe 16 and may be configured to engage attachment ends of a respective counterweight 20. In one illustrative example, the connecting member 18 is a threaded shaft configured to receive a threaded bore (attachment end) disposed one the end of a respective counter weight 20.

The method 200 proceeds to step 220, gripping the sleeve 12/112, wherein the user rotates his hand(s) and arm(s) in a circular motion (indicated by the blue arrow in FIGS. 4*a*, 4*b* and the arrow in FIG. 5) wherein the sleeve 12/112 is moved along an orbital path (indicated by the dashed circle) generally disposed on a vertical plane.

As the user rotates the sleeve 12/112 along an orbital path, the muscles are creating torque on the sleeve 12/112, pipe 16/116 and counterweights 20/120, which is necessary to maintain centripetal force sufficient to keep the counterweights 20/120 spinning about the pipe 16/116. Centripetal force makes the counterweights 20/120 follow a curved path. Centripetal force is directed orthogonal to the velocity of the counterweight 20/120 which subsequently requires the muscles to actuate to overcome the opposing force of the counterweight 20/120. The sleeve 12/112 may be rotated either clockwise or counterclockwise. The centripetal force causes the pipe 16/116 to rotate within the sleeve 12/112 as a result of the counterweight 20/120 rotating about the longitudinal axis of the pipe 16/116.

The method includes step 230 wherein step 220 is completed for a predetermined period of time. The method may be executed by gripping the sleeve 12 with both hands, as indicated in step 220*a*. Alternatively, the method may be executed by gripping sleeve 112 with one hand, the working hand) wherein the free hand is positioned lower than the working hand. The free hand stabilizing a bottom end of the pipe 116 while the working hand rotates the sleeve 112, as indicated in step 220*b*

Accordingly, the user does not need to worry about possible vertebrae damage while trying to strengthen the neck due to the small loads being used. Accordingly, the exercise equipment 10 utilizes rotational pulse technology to provide micro bits of load at predetermined frequencies onto the muscle groups comprising the neck, shoulders, arms, and chest of the user so as to provide an impact-efficient exercise.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method of exercising for strengthening a core of a user by performing a rotational motion using two hands, wherein one hand being a working hand and the other hand being a stabilizing hand, the method comprising the steps of:

providing an exercise equipment comprising:

a sleeve having a bore;

a pipe, a portion of the pipe disposed within the sleeve, the sleeve concentric to the pipe and an outer surface of the pipe is spaced apart from an inner surface of the sleeve, wherein the sleeve is slidably mounted to the pipe so as to move along and about a longitudinal axis of the pipe; and a counterweight mounted to an end of the pipe, the counterweight generating a pulse when rotated along a longitudinal axis of the pipe;

gripping the sleeve with the working hand and rotating the sleeve;

gripping the sleeve with the stabilizing hand, wherein the stabilizing hand is positioned lower than the working hand, wherein the user rotates the sleeve with the working hand in a circular motion so as to move the sleeve along an orbital path, wherein the sleeve is moved relative to the pipe, causing the pipe to abut against the inner surface of the sleeve, wherein the pipe rides within an inner circumferential surface of the sleeve causing the counterweight to rotate about the longitudinal axis of the pipe so as to generate a pulse, the pulse actuating muscles of the user.

2. The method as set forth in claim 1, wherein the user rotates the sleeve for a predetermined period of time.

* * * * *